US009899786B2

(12) United States Patent
Watkins

(10) Patent No.: US 9,899,786 B2
(45) Date of Patent: Feb. 20, 2018

(54) COAXIAL CABLE COMPRESSION TOOL

(71) Applicant: PPC Broadband, Inc., East Syracuse, NY (US)

(72) Inventor: Harold J. Watkins, Chittenango, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 312 days.

(21) Appl. No.: 14/621,089

(22) Filed: Feb. 12, 2015

(65) Prior Publication Data

US 2015/0229089 A1 Aug. 13, 2015

Related U.S. Application Data

(60) Provisional application No. 61/939,311, filed on Feb. 13, 2014.

(51) Int. Cl.
*H01R 43/042* (2006.01)
*H01R 9/05* (2006.01)

(52) U.S. Cl.
CPC ..... *H01R 43/0425* (2013.01); *H01R 9/0524* (2013.01); *Y10T 29/53235* (2015.01)

(58) Field of Classification Search
CPC ..... H01R 43/042; H01R 9/05; H01R 9/0518; H01R 43/0425; Y10T 29/53226; Y10T 29/53235; Y10T 29/53257
See application file for complete search history.

(56) References Cited

U.S. PATENT DOCUMENTS 5,435,167 A 7/1995 Holliday et al.
5,596,800 A 1/1997 Holliday et al.
5,931,437 A 8/1999 Tarpill
6,089,913 A * 7/2000 Holliday ..... B25B 27/10 439/462
6,112,404 A 9/2000 Tarpill
6,272,738 B1 * 8/2001 Holliday ..... B25B 7/02 29/751
6,363,560 B1 4/2002 Kesinger
6,820,326 B1 11/2004 Tarpill et al.
7,210,327 B1 5/2007 Tarpill et al.
7,513,795 B1 4/2009 Shaw
7,596,860 B2 10/2009 Sutter et al.
7,607,218 B2 * 10/2009 Montena ..... H01R 9/0518 29/751
7,627,944 B2 12/2009 Holliday
(Continued)

OTHER PUBLICATIONS

Shop Belden Coax Crimper stripper, Lowes. pdf.*

*Primary Examiner* — Peter DungBa Vo
*Assistant Examiner* — John S Lowe
(74) *Attorney, Agent, or Firm* — Oliff PLC

(57) ABSTRACT

A compression tool including, in one embodiment, a fixed base, a compression member and a bi-directionally pivoting handle. The fixed base includes a static plunger for engaging a portion of a cable connector while the compression member slideably engages the fixed base along a line of action. The handle pivotally mounts to the fixed base and bi-directionally pivots about the axis to slide the compression member in one direction to facilitate loading of a connector body into a recess of the compression member, and in the other direction, to compress the connector body and the connector portion thereby coupling a cable to the connector body.

16 Claims, 9 Drawing Sheets

(56) References Cited

U.S. PATENT DOCUMENTS

| | | | | |
|---|---|---|---|---|
| 7,797,827 | B2 | 9/2010 | Sutter | |
| 7,841,896 | B2 | 11/2010 | Shaw et al. | |
| 8,015,698 | B2 | 9/2011 | Sutter et al. | |
| 8,132,323 | B2 * | 3/2012 | Rodrigues | H01R 4/20 29/280 |
| 8,166,639 | B2 | 5/2012 | Jones | |
| 8,256,102 | B2 | 9/2012 | Sutter et al. | |
| 8,336,197 | B2 | 12/2012 | Jones | |
| 8,464,422 | B2 | 6/2013 | Holliday et al. | |
| 8,539,669 | B2 | 9/2013 | Holliday | |
| 8,371,874 | B2 | 12/2013 | Shaw et al. | |
| 8,627,562 | B2 | 1/2014 | Sutter et al. | |
| 8,834,200 | B2 | 9/2014 | Shaw | |
| 8,875,387 | B2 | 11/2014 | Youtsey | |
| 9,509,111 | B1 * | 11/2016 | Liao | H01R 43/042 |
| 2006/0143904 | A1 | 7/2006 | Holliday | |
| 2007/0251085 | A1 | 11/2007 | Holliday et al. | |
| 2008/0189936 | A1 | 8/2008 | Sutter et al. | |
| 2009/0004914 | A1 | 1/2009 | Sutter | |
| 2009/0170360 | A1 | 7/2009 | Shaw et al. | |
| 2009/0176407 | A1 | 7/2009 | Shaw | |
| 2009/0313818 | A1 | 12/2009 | Sutter et al. | |
| 2010/0077604 | A1 | 4/2010 | Holliday | |
| 2010/0139086 | A1 | 6/2010 | Sutter et al. | |
| 2010/0313412 | A1 | 12/2010 | Youtsey | |
| 2011/0065317 | A1 | 3/2011 | Shaw et al. | |
| 2012/0017432 | A1 | 1/2012 | Sutter et al. | |
| 2012/0279057 | A1 | 11/2012 | Holliday | |
| 2013/0149884 | A1 | 6/2013 | Shaw | |
| 2015/0040385 | A1 | 2/2015 | Youtsey | |
| 2016/0006225 | A1 * | 1/2016 | Watkins | H02G 1/1224 30/91.2 |

* cited by examiner

COAXIAL CABLE COMPRESSION TOOL

CROSS-REFERENCE TO RELATED APPLICATION

This non-provisional patent application claims the benefit and priority of U.S. Provisional Patent Application No. 61/939,311, filed on Feb. 13, 2014. The entire contents of such application are hereby incorporated by reference.

BACKGROUND

The installation of coaxial cable connectors onto an end of a coaxial cable typically involves the use of specialized tools. An example of one such specialized tool is a compression device operative to secure a connector to a prepared end of the coaxial cable. An internal post is typically employed to react radial loads imposed by a connector body as the compression device causes a compression cap or a folding bellows sleeve to compress the connector body against an elastomer outer jacket of the coaxial cable. Alternatively, or additionally, such compression tools may also be used to press a barbed end of an internal post into engagement with the outer conductor and elastomer jacket to retain the cable relative to the internal post.

In addition to the specialized nature of such tools, the cost thereof can be sufficiently high to prohibit customers, in cost sensitive markets, from purchasing coaxial cable connectors. Additionally, the high number of component parts associated with prior art compression tools increases the cost of fabrication, maintenance and repair. At the same time, the high number of component parts reduces the reliability of such compression tools.

The foregoing background describes some, but not necessarily all, of the problems, disadvantages and challenges related to compression tools.

SUMMARY

A compression tool is provided, which in one embodiment includes a fixed base, a compression member and a bi-directionally pivoting handle. The fixed base includes a plunger for engaging an insert of a cable connector. The compression member slideably engages the fixed base and defines first and second cam follower surfaces. The handle pivotally mounts to the fixed base and includes first and second cam engagement surfaces engaging the first and second cam follower surfaces. The handle bi-directionally pivots about the axis to slide the compression member in one direction to facilitate loading of a connector body into a recess of the compression member, and in the other direction, to compress the connector body and the insert thereby coupling the body and the coaxial cable.

Additional features and advantages of the present disclosure are described in, and will be apparent from, the following Brief Description of the Drawings and Detailed Description.

DETAILED DESCRIPTION

Figure 2:
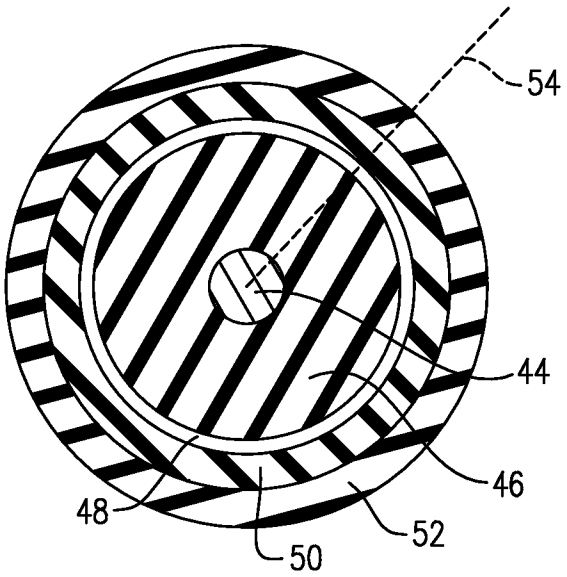
FIG. 2 is a cross-sectional view of the cable, taken substantially along line 2-2 of FIG. 1.

The compression tool shown in the illustrated embodiments is intended to couple a coaxial cable connector to a prepared end of a coaxial cable. While the cable may be constructed from a variety of materials and comprise a plurality of cross-sectional configurations, it will generally include a center or inner conductor, an outer conductor circumscribing the inner conductor, a dielectric material interposing the inner and outer conductors to provide an electrical insulator therebetween, and a compliant outer sheath disposed over the outer conductor. Similarly, the cable connectors will typically include a body disposed over and engaging the compliant outer sheath, an insert or post interposing the dielectric material and the outer conductor, and a coupler connected to the body and/or the insert for mechanically and/or electrically connecting the connector to an interface port.

Cable

In FIGS. 1-4, a coaxial cable 4 according to one embodiment includes: (a) an elongated center conductor or inner conductor 44; (b) an elongated insulator 46 coaxially surrounding the inner conductor 44; (c) an elongated, conductive foil layer 48 coaxially surrounding the insulator 46; (d)

an elongated outer conductor 50 coaxially surrounding the foil layer 48; and (e) an elongated sheath, sleeve or jacket 52 coaxially surrounding the outer conductor 50.

The inner conductor 44 is operable to carry data signals to and from the data network 5. Depending upon the embodiment, the inner conductor 44 can be a strand, a solid wire or a hollow, tubular wire. The inner conductor 44 is, in one embodiment, constructed of a conductive material suitable for data transmission, such as a metal or alloy including copper, including, but not limited, to copper-clad aluminum ("CCA"), copper-clad steel ("CCS") or silver-coated copper-clad steel ("SCCCS").

The insulator 46, in one embodiment, is a dielectric having a tubular shape. In one embodiment, the insulator 46 is radially compressible along a radius or radial line 54, and the insulator 46 is axially flexible along the longitudinal axis 42. Depending upon the embodiment, the insulator 46 can be a suitable polymer, such as polyethylene ("PE") or a fluoropolymer, in solid or foam form.

Figure 1:
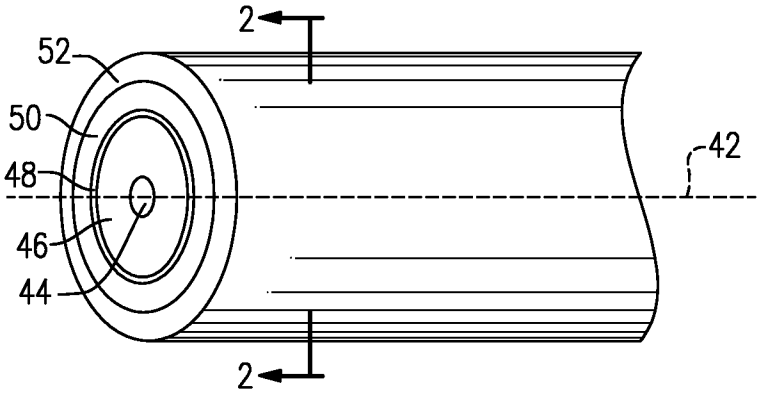
FIG. 1 is a broken-away isometric view of a cable which is configured to be operatively coupled to a multichannel data network.

In the embodiment illustrated in FIGS. 1 and 2, the outer conductor 50 includes a conductive RF shield or electromagnetic radiation shield. In such embodiment, the outer conductor 50 includes a conductive screen, mesh or braid or otherwise has a perforated configuration defining a matrix, grid or array of openings. In one such embodiment, the braided outer conductor 50 has an aluminum material or a suitable combination of aluminum and polyester. Depending upon the embodiment, cable 4 can include multiple, overlapping layers of braided outer conductors 50, such as a dual-shield configuration, tri-shield configuration or quad-shield configuration.

In one embodiment, as described below, a cable connector electrically grounds the outer conductor 50 of the coaxial cable 4. When the inner conductor 44 and external electronic devices generate magnetic fields, the grounded outer conductor 50 sends the excess charges to ground. In this way, the outer conductor 50 cancels all, substantially all or a suitable amount of the potentially interfering magnetic fields. Therefore, there is less, or an insignificant, disruption of the data signals running through inner conductor 44. Also, there is less, or an insignificant, disruption of the operation of external electronic devices near the cable 4.

The conductive foil layer 48, in one embodiment, is an additional, tubular conductor which provides additional shielding of the magnetic fields. In one embodiment, the foil layer 48 includes a flexible foil tape or laminate adhered to the insulator 46, assuming the tubular shape of the insulator 46. The combination of the foil layer 48 and the outer conductor 50 can suitably block undesirable radiation or signal noise from leaving the cable 4. Such combination can also suitably block undesirable radiation or signal noise from entering the cable 4. This can result in an additional decrease in disruption of data communications through the cable 4 as well as an additional decrease in interference with external devices, such as nearby cables and components of other operating electronic devices.

In one embodiment, the jacket 52 has a protective characteristic, guarding the cable's internal components from damage. The jacket 52 also has an electrical insulation characteristic. In one embodiment, the jacket 52 is compressible along the radial line 54 and is flexible along the longitudinal axis 42. The jacket 52 is constructed of a suitable, flexible material such as polyvinyl chloride (PVC) or rubber. In one embodiment, the jacket 52 has a lead-free formulation including black-colored PVC and a sunlight resistant additive or sunlight resistant chemical structure.

Figure 3:
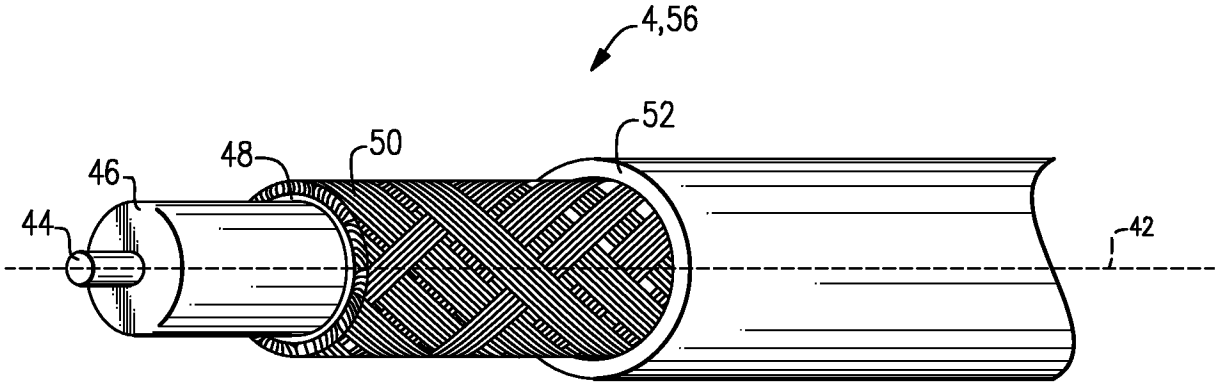
FIG. 3 is a broken-away isometric view of a cable which is configured to be operatively coupled to the multichannel data network, illustrating a cable which has been spliced into a three-stepped prepared end.
Figure 4:
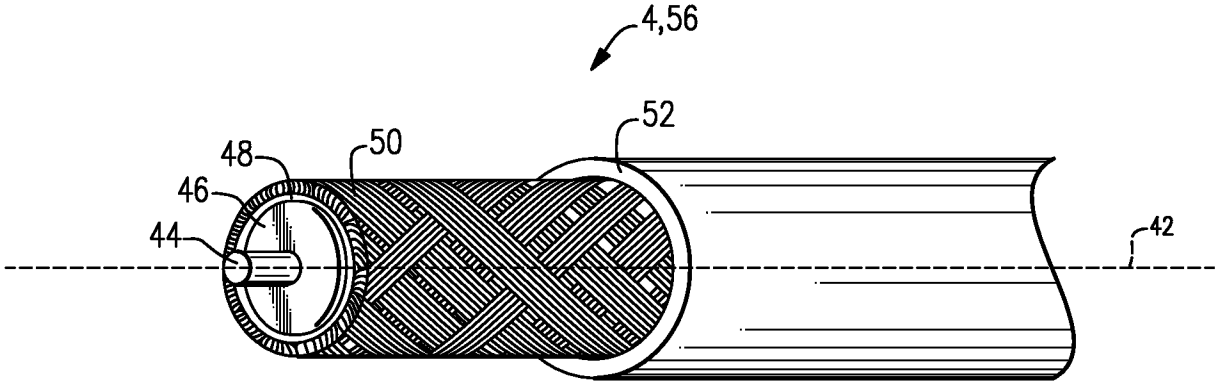
FIG. 4 is a broken-away isometric view of a cable which is configured to be operatively coupled to the multichannel data network, illustrating a cable which has been spliced into a two-stepped prepared end.

Referring to FIGS. 3 and 4, in one embodiment an installer or preparer prepares a terminal end 56 of the cable 4 so that it can be mechanically connected to the connector (discussed in greater detail below). To do so, the preparer removes or strips away differently sized portions of the jacket 52, outer conductor 50, foil 48 and insulator 46 so as to expose the side walls of the jacket 52, outer conductor 50, foil layer 48 and insulator 46 in a stepped or staggered fashion. In the example shown in FIG. 5, the prepared end 56 has a three step-shaped configuration. In the example shown in FIG. 6, the prepared end 58 has a two step-shaped configuration. The preparer can use cable preparation pliers or a cable stripping tool to remove such portions of the cable 4. At this juncture, the cable 4 is ready to be connected to the connector.

Figure 5:
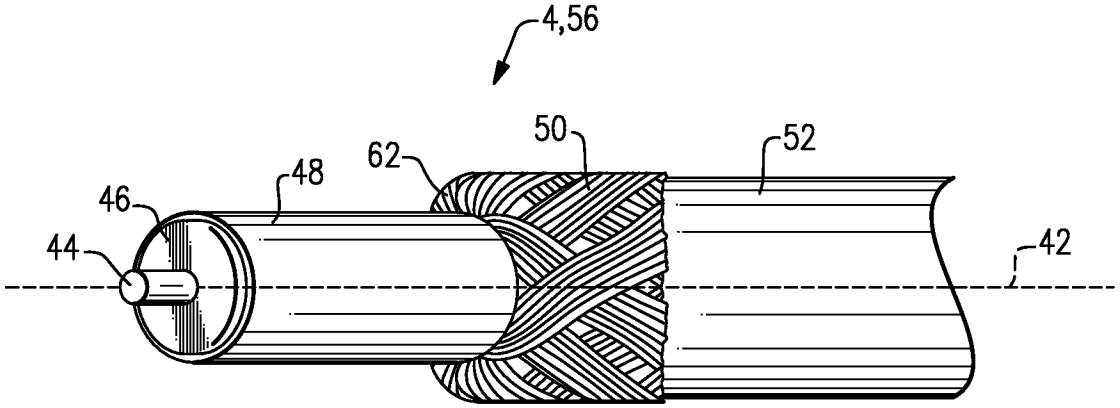
FIG. 5 is a broken-away isometric view of a cable which is configured to be operatively coupled to the multichannel data network, illustrating the folded-back, braided outer conductor of the prepared cable end.

In one embodiment illustrated in FIG. 5, the installer or preparer performs a folding process to prepare the cable 4 for connection to the connector. In the example illustrated, the preparer folds the braided outer conductor 50 backward onto the jacket 52. As a result, the folded section 60 is oriented inside out. The bend or fold 62 is adjacent to the foil layer 48 as shown. In such embodiments, the folding process can facilitate the insertion of an insert or post (discussed in the subsequent section) between the braided outer conductor 50 and the foil layer 48.

Connector

Figure 6:
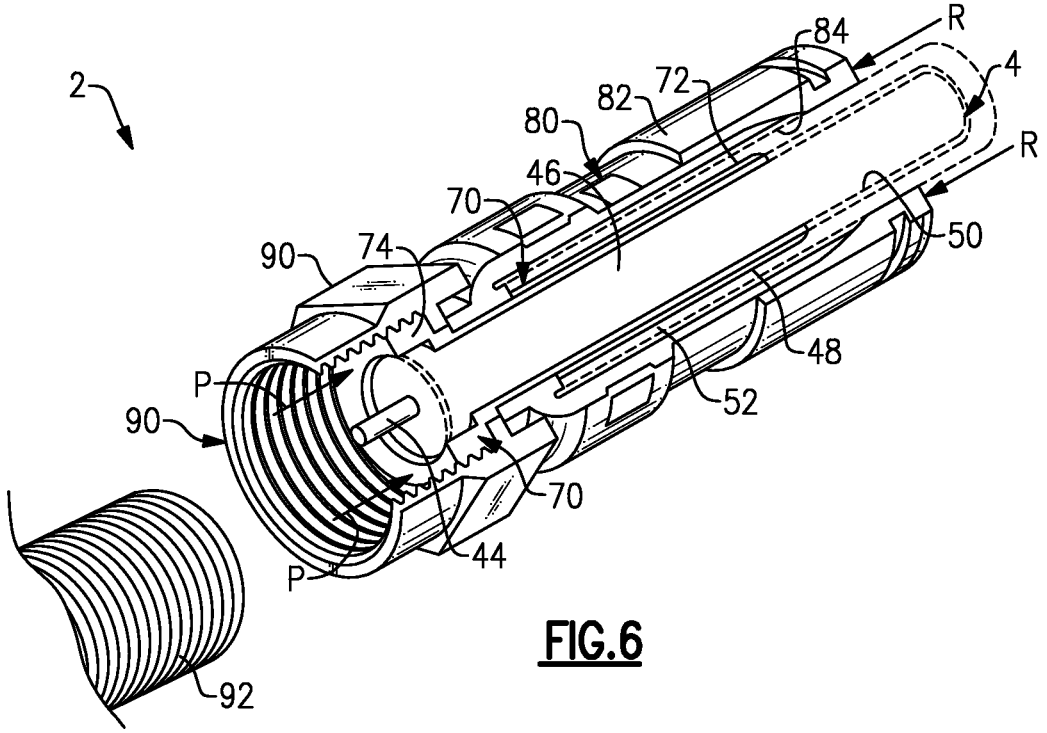
FIG. 6 is a broken-away perspective view of a coaxial cable connector which may be secured to the prepared end of the cable using one embodiment of the compression tool disclosed herein.

In FIG. 6 a perspective view of a coaxial cable connector 2 shows a portion of the connector, e.g., an insert or post 70, interposing the braided outer conductor 50/the foil layer 48 and the dielectric core 46. The components of the prepared cable 4, i.e., the braided outer conductor 50, the foil layer 48, the dielectric core 46 and the center conductor 44 are shown in dashed or phantom lines.

A body 80 circumscribes an aft or barbed end portion 72 of the insert 70 while a coupler 90 circumscribes, and axially engages, a forward or flanged end portion 74 of the insert 70. In the described embodiment, the aft end of the body 80 includes a compression cap 82 having a tapered internal surface 84 for radially engaging the aft or barbed end portion 72 of the insert 70. When the compression cap 82 is axially displaced over the body 80, such as by axially compressing the forward end portion 74 of the post or insert 70 toward the body 80 in the direction of arrow P (i.e., while the compression cap 82 is held in fixed by an axial force R), the tapered internal surface 84 of the body 80 is driven radially into the jacket 52 of the cable 4. Furthermore, the jacket 52 and outer conductor 50 are driven radially toward, and against, the barbed end 72 of the insert 70. As such, the annular barb 72 hooks the outer conductor 50 to prevent retraction of the insert 70 from the connector body 80.

While the illustrated embodiment depicts a female F-type connector, i.e., the coupler 90 includes internal threads for engaging a male interface port 92, it should be appreciated that other connectors, e.g., a male connector, may also be prepared in a similar manner. As such, a compression tool such as that described below may also facilitate preparation and engagement of a variety of other connectors.

Compression Tool

In FIGS. 7 through 10, a coaxial cable compression tool 100 comprises: (i) a guide frame or fixed base 102 having a static plunger 104 (see FIG. 8) disposed in opposed relation to the connector 2, (ii) a moveable slide or compression member 106 having a recess 108 for accepting a connector 2 assembled in combination with a prepared end of a coaxial cable (such as the prepared end shown in FIG. 5), and (iii) a lever arm or handle 110 pivotally mounted about an axis 110A to the fixed base 102. The handle 110 may be bi-directionally pivoted about the axis 110A to axially displace the compression member 106 along a line-of-action LOA, i.e., away from the pivot axis 110A to facilitate loading of the connector within the recess 108 and toward the pivot axis 110A such that a portion of the connector, e.g., the connector post or insert 70, may be compressed together with a connector body 80.

With respect to the latter, the line-of-action LOA is orthogonal to the pivot axis 110A and the plunger 104 is axially opposed to a connector (i.e., when the connector 2 is loaded into the recess 108) such that the static plunger 104 may impart a compressive force F when the compression member 102 is drawn into or toward the static plunger 104. As was mentioned in the preceding section, the connector body 80 is compressed by securing the connector insert 70 against the static plunger 104 and the compression cap 82 against the forward end 112 of the compression member 106, The compressive force F drives the body 80 inwardly against the compliant outer jacket 52 and the annular barb 72 of the insert 70 as the tapered surfaces 74 of the compression cap 82 slide over the compliant terminal end of the body 80.

Figure 8:
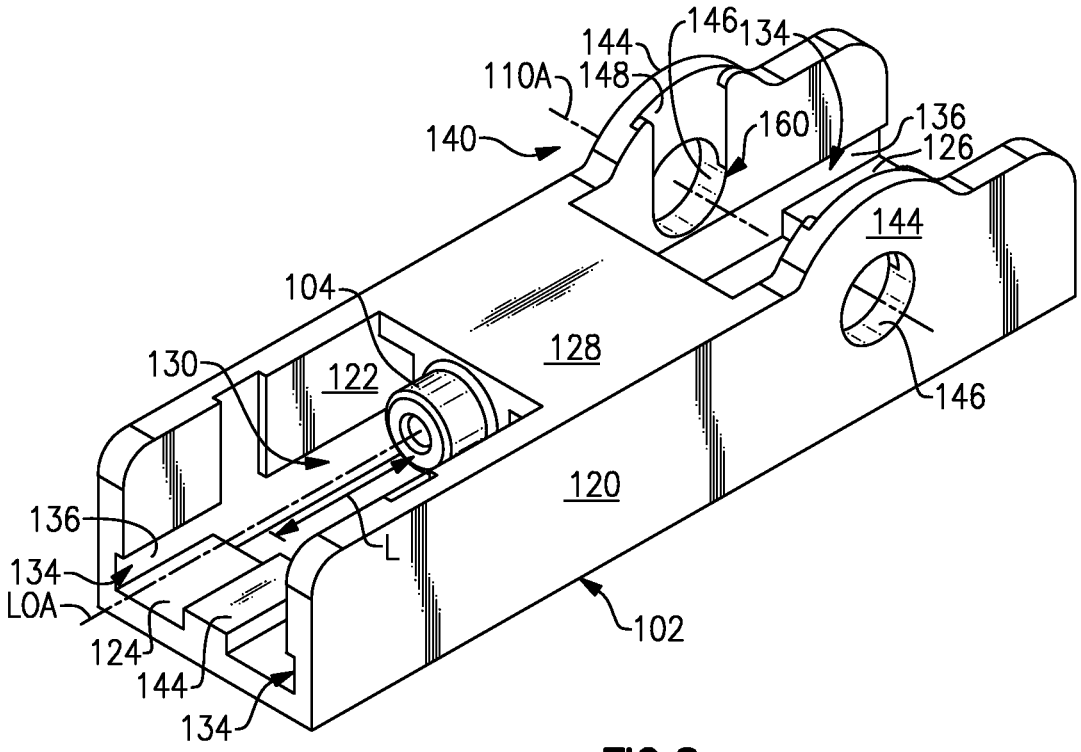
FIG. 8 is an isolated isometric view of a fixed base of the coaxial cable compression tool shown in FIG. 7, the fixed base including a plunger for securing an insert of the connector into a body of the connector during a working movement of the compression tool.
Figure 9:
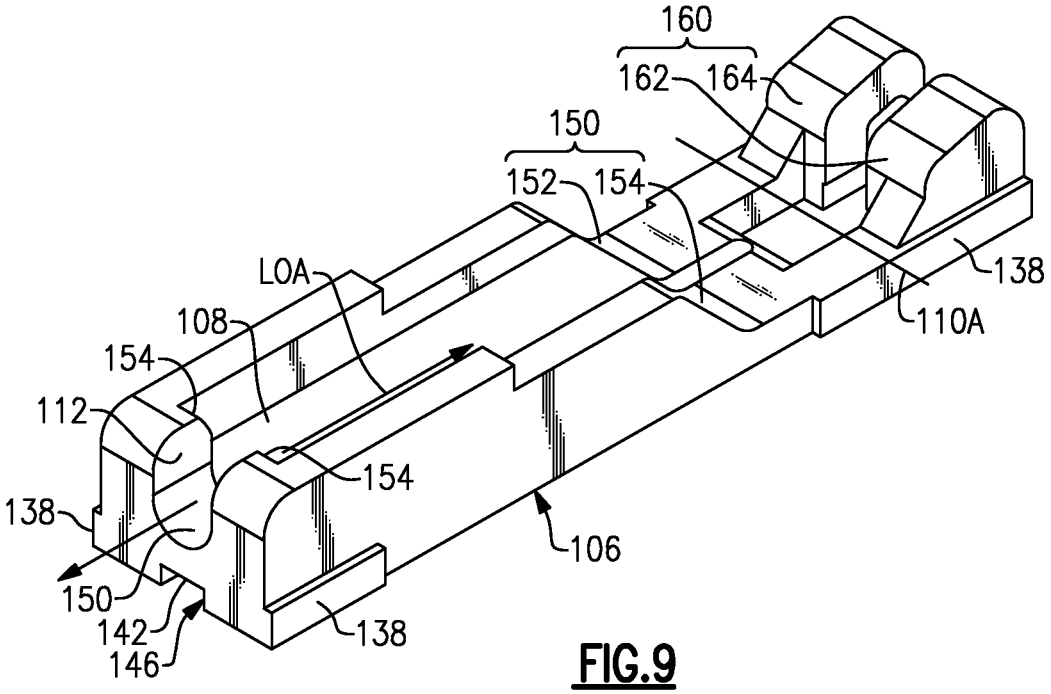
FIG. 9 is an isolated isometric view of a moveable compression member for assembly with the fixed base shown in FIG. 8, the moveable compression member including a recess having a U-shaped opening for urging the body toward the plunger of the fixed base to compress the connector body and secure the cable to the connector.

In FIGS. 8 and 9, the fixed base 102 includes sidewalls 120, 122 which are structurally interconnected by forward, aft and intermediate cross members 124, 126, 128. In the described embodiment, the forward and aft cross members 124, 126 structurally integrate the sidewalls 120, 122 along the lower edges or base portions thereof. The intermediate cross member 128 structurally integrates the sidewalls 120, 122 along an upper edge while supporting the static plunger 104 midway along the intermediate cross member 128. The cross-members 124, 126, 128 and sidewalls 120, 122, furthermore, define a space 130 for enclosing and guiding the compression member 106 along the line-of-action LOA. More specifically, the sidewalls 120, 122 each include a linear channel 134 defining at least one linear bearing surface 136 for accepting at least one guide rail or bearing block 138 of the compression member 106. Additionally, or alternatively, the forward cross member 126 also defines a bearing block 144 for slideably engaging a linear bearing surface 142 formed along a linear channel 146 of the compression member 106. The channel 146 is disposed along the underside of the compression member 106.

While the cooperating channels 134, 146 provide linear bearing surfaces 136,142 to facilitate longitudinal displacement of the compression member 106 along the line-of-action LOA, the cooperating bearing surfaces and bearing blocks 134, 136, 142, 144 also provide lateral and vertical, i.e., side-to-side, up-and-down, retention of the compression member 106 relative to the fixed base 102. While the guide rails 138, 144 and cooperating linear bearing surfaces 136, 142, are formed in the compression member 106 and fixed base 102, respectively, it should be appreciated that the guide rails 138, 144 and bearing surfaces 136, 142, may be formed in either one of the compression member 106 and the fixed base 102.

The fixed base 102 also includes a cradle support 140 for pivotally mounting the handle 110 to the base 102. More specifically, the cradle support 140 includes a pair of lug fittings or structures 144 which are integrated with the sidewall structures 120, 122 of the fixed base 102, immediately aft of the intermediate or upper cross member 128. Furthermore, each of the lug structures 144 defines a partial cylindrical bearing surface 146 which opens to a channel 148 extending vertically from the partial bearing surface 146 to an upper portion of the respective lug structure 144. As such, the partial bearing surface 146 inscribes an arc of at least one-hundred and eighty degrees (180°) and, in the described embodiment, the bearing surface 146 inscribes an arc which is slightly greater than one-hundred and eighty degrees (180°) to effect a snap-fit journal mount with the handle 110 (described in greater detail below).

As mentioned in a preceding paragraph, the compression member 106 is disposed within the space 130 provided between the cross-members 124, 126, 128 and the sidewalls 120, 122, Further, the linear bearing surfaces 136, 142 of the fixed base 102 and compression member 106 function to guide the compression member 106 along the line-of-action LOA. The lengthwise dimension L of the recess 108, i.e., the dimensions along the LOA, is selected to achieve a prescribed connector length, i.e., between the interface and cable connecting ends of the connector 2. That is, the length dimension L of the recess 108 accommodates a connector of a prescribed size, such that a predetermined range of handle motion effects a known, predictable and repeatable amount of compression cycles on the body 80 of the connector 2.

The recess 108 of the compression member 106 includes a U-shaped opening 150 in the forward wall 112 thereof to facilitate the passage of the prepared end of the coaxial cable 4. Furthermore, the U-shaped opening 108 produces a shoulder 154 which abuts a peripheral edge of the connector 2 when received in the recess 108. As such, the forward wall 112 applies the requisite compressive force on the connector body 80 when the handle 110 axially displaces the compression member 106 toward the plunger 104 of the fixed base 102.

The compression member 106 also includes cam follower surfaces 150, 160 on each side of the handle pivot axis 110A and, in the described embodiment, includes a forward cam follower surface 150 and an aft cam follower surface 160. In the described embodiment the cam follower surfaces 150, 160 are bifurcated to form a pair of forward cam follower surfaces 152, 154 and a pair of aft cam follower surfaces 162, 164.

Figure 7:
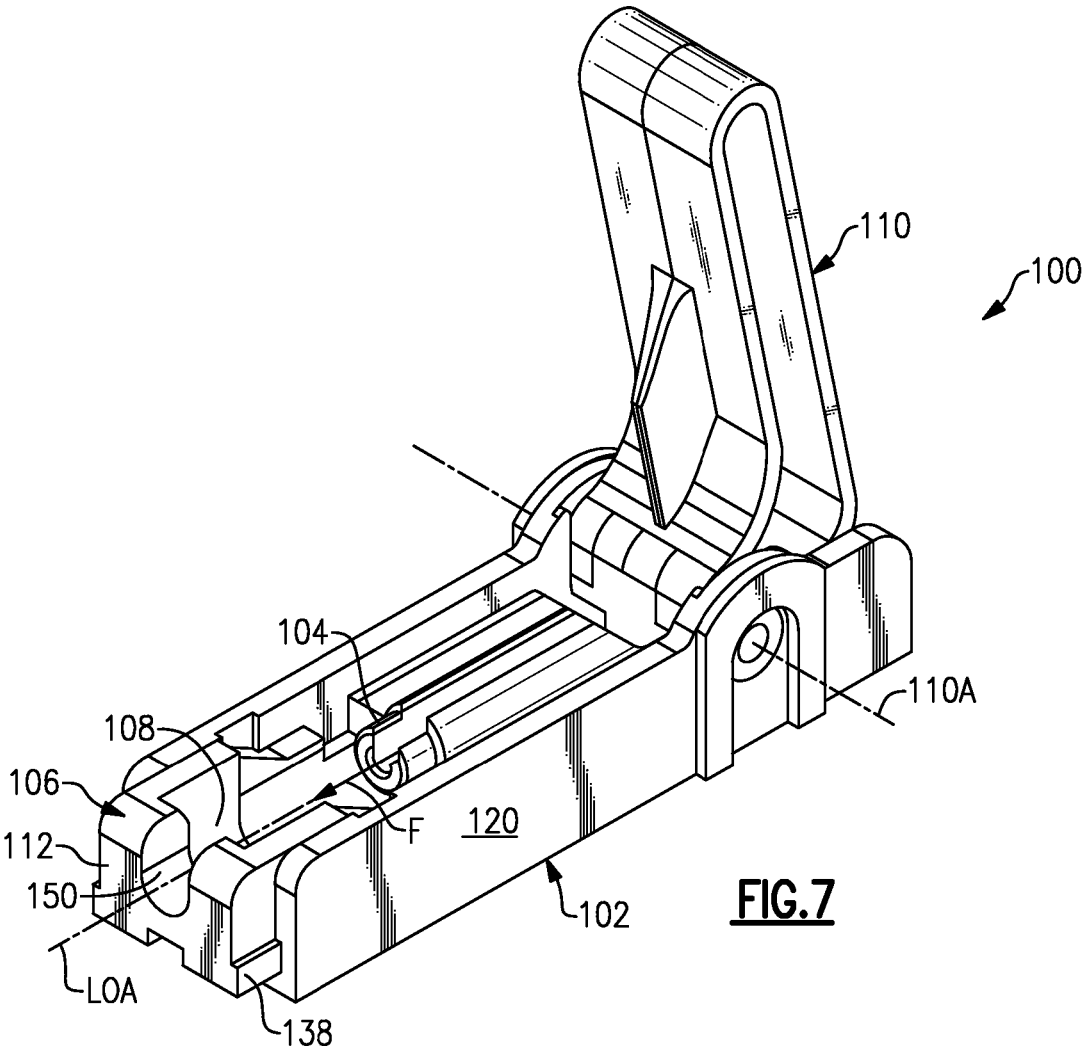
FIG. 7 is an isometric view of a compression tool according to one embodiment operative to couple the prepared end of the cable to a cable connector.
Figure 10:
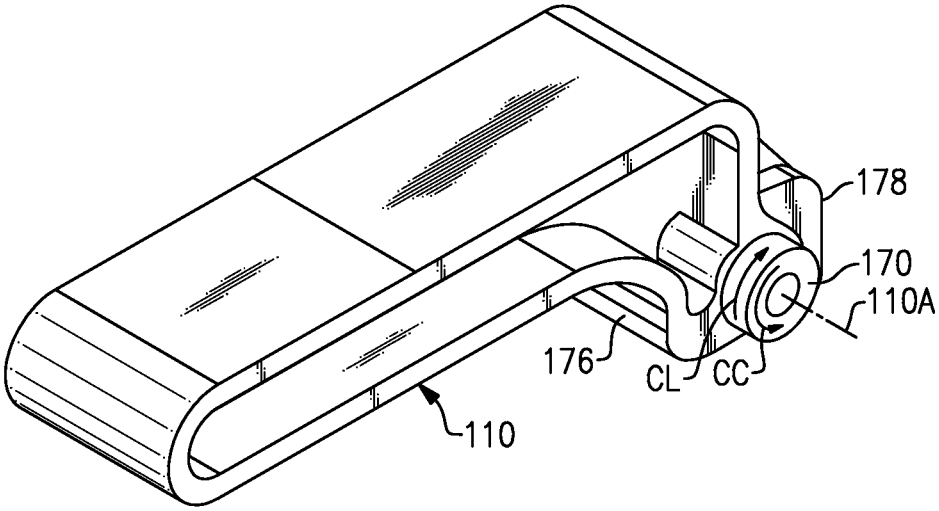
FIG. 10 is an isolated isometric view of a moveable handle for being pivotally mounted within a cradle support of the fixed base shown in FIG. 9, the moveable handle including a stub axle projecting from a lug structure of the cradle support.

In FIGS. 7 and 10, the handle 110 includes a pair of stub axles 170 (only one can be seen in FIG. 7) projecting laterally from each side of the handle 110. The stub axles 170 rotate within the partial bearing surfaces 146 of the lug structures 144 to produce a journal bearing mount for pivotally connecting the handle 110 to the fixed base 102. As described previously, the partial bearing surfaces 146 open to vertical channels 128 which allow the stub axles 170 to slide vertically into the journal mount. The vertical channels 128 neck down in size at the transition 160 between the channel 128 and cylindrical bearing surface 146 such that the stub axles 170 are snap-fit into engagement, i.e., as the stub axles 170 pass from the channel 128 into the cylindrical bearing surface 144. It will be appreciated that the necked-down transition 160 retains the handle 110 relative to the fixed base 102.

The handle 110 rotates about the pivot axis 110A and includes forward and aft cam engagement surfaces 176, 178 disposed on each side of the pivot axis 110A. The forward and aft cam engagement surfaces 176, 178 of the handle 110 essentially extend from one side of the handle 110 to the opposite side. Rotation of the handle 110 in a clockwise direction CL causes the forward cam engagement surfaces 176 to engage the forward cam follower surfaces 152, 154 to displace the moveable compression member 106 forwardly to an open position. Rotation of the handle 110 in a counter-clockwise direction CC causes the aft cam engagement surfaces 178 to engage the aft cam follower surfaces 162, 164 to displace the moveable compression member 106 rearwardly to a fully compressed position.

Figure 11:
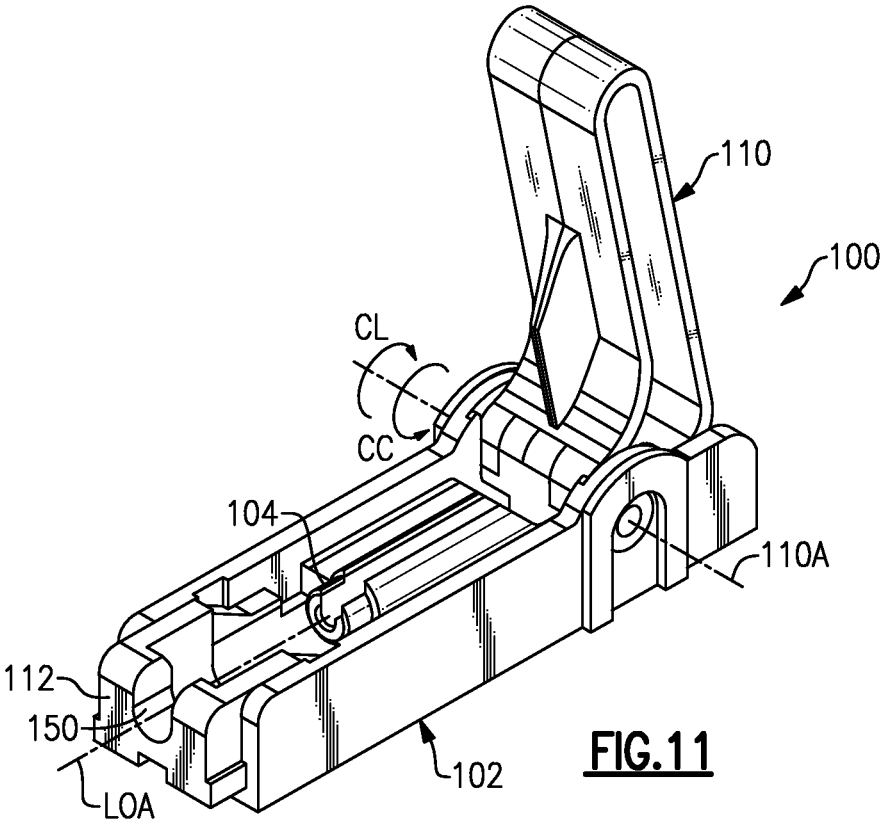
FIG. 11 is an isometric view of one embodiment of the compression tool wherein the handle has been rotated to an open position to facilitate loading of the connector into the recess of the compression member.
Figure 12:
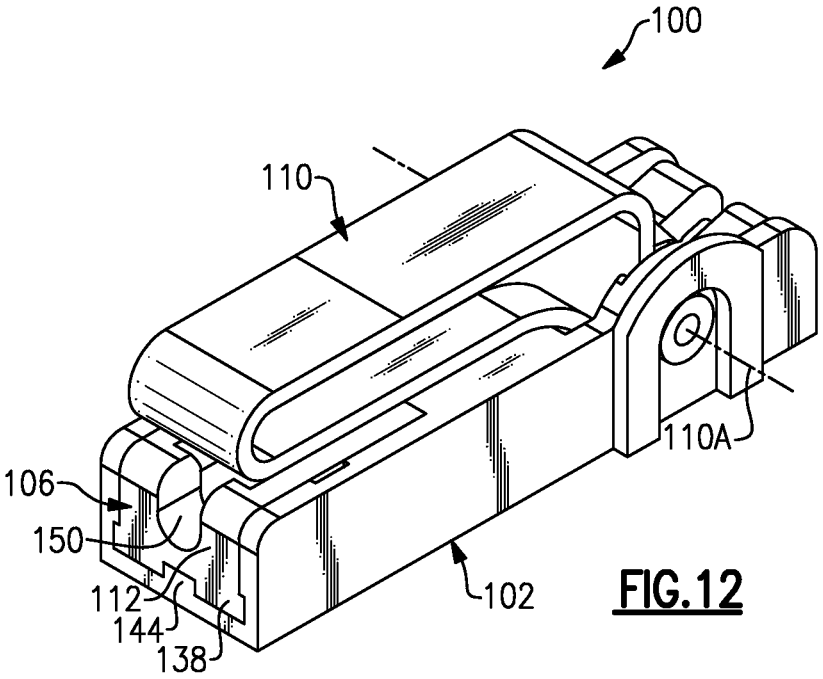
FIG. 12 is an isometric view of one embodiment of the compression tool wherein the handle has been rotated into a fully compressed position to compress the insert and connector body thereby securing a prepared end of a cable in combination with a cable connector.

In operation, and referring to FIGS. 11 and 12, the handle 110 is initially rotated in a clockwise direction CL to a substantially vertical position (FIG. 11). Furthermore, when the handle 110 is vertical, the front wall 112 of the moveable compression member 106 is brought forward of the fixed base 102. In this open position, the recess 108 is fully-accessible to accept a cable connector. Upon preparation of a connector, an installer places the connector 2 into the recess 108 such that an open end 190 of the connector 2 faces the static plunger 104. Inasmuch as the installer may physically place the insert 70 between the dielectric core 46 and the braided outer conductor 50, the insert 70 may partially protrude beyond the connector body 80.

Rotation of the handle 110 in a counter-clockwise direction CC causes the forward cam engagement surface 176 of the handle 110 to urge the moveable compression member 106 rearwardly toward the static plunger 104. As a portion of the connector 2 comes into contact with the static plunger 104, the installer continues to rotate the handle 110 downwardly to a horizontal position to fully compress the connector 2 against the static plunger 104. When the handle 110 has been fully rotated, the moveable compression member 106 is in its fully compressed position. In this position, the compression cap 82 may be urged forwardly onto the body 80 such that the tapered internal surface 84 of the compression cap 82 radially displaces the body 80 against the barbed end 72 of the insert 70. As such, the barbed end 72 prevents the insert 70 from backing away from, or out of, the connector body 80. Thereafter, the moveable compression member 106 returns to a ready position, i.e., the open position, by rotating the handle 110 in a clockwise direction CL.

While the connector 2 depicted employs a conventional compression cap 82 to secure the prepared end of the cable 4 to the connector 2, other connector configurations may be used in conjunction with the compression tool 100. For example, a connector may employ a bellows structure (not shown) to fold into and engage an outer periphery of the coaxial cable 4, i.e., the elastomeric jacket 52. In some connectors the post is driven deeply into the body and in others the stroke of the insert or post is relatively short. Furthermore, to accommodate different size connectors, the static plunger 104 may threadably engage an internal post (not shown), to vary the accessible length or size of the recess 108.

The compression tool 100 excludes pins, screws, bolts and similar fasteners. The moveable compression member 106 fits into the fixed base 102 without any fasteners. The handle 110 is connected to the base 102 though a snap-fit connection without any fasteners. Specifically, the stub axles 170 of the handle snap into the bearing surfaces 172, 174 of the base. In one embodiment, the compression tool has a fastener-free configuration with three parts, a unitary fixed base 102 (having a static plunger 104 integral with the fixed base 102), a unitary compression member 106 and a unitary handle 110.

The compression tool 100 may be fabricated using relatively low cost molding techniques. For example, each of the three components, i.e., the fixed base 102, moveable compression member 106, and handle 110 may be injection molded using a relatively low friction thermoplastic polymer. Since the components are fabricated from a self-lubricating thermoplastic, frictional wear and abrasion between mating components is minimized. That is, there is no need to lubricate the moving components. Finally, since the compression tool 100 may be fabricated from as few as three components, the low number of component parts improves the reliability and lowers the cost of the compression tool 100.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. A compression tool, comprising:

a fixed base defining a line of action, a cradle support defining a pivot axis orthogonal to the line-of-action, and a plunger configured to secure an end of a connector insert;

a compression member configured to slideably engage the fixed base along the line-of-action and receive a connector body within a recess, the compression member having cam follower surfaces radially-spaced from the pivot axis of the fixed base, the compression member including a forward cam follower surface disposed forwardly of the pivot axis and an aft cam follower surface disposed aft of the pivot axis; and a handle having a cam engagement surface operatively coupled to each of the cam follower surfaces and pivotally mounted to the cradle support to bi-directionally displace the compression member to an open position and to a fully compressed position, the handle including forward and aft cam engagement surfaces, wherein the handle is rotated in one direction to slideably displace the compression member forward to the open position and rotated in the other direction to slideably displace the compression member aft to the fully compressed position.

2. The compression tool of claim 1 wherein the compression member slides forward to the open position to facilitate loading of a connector into the recess and wherein the compression member slides aft to the fully compressed position to compress the connector insert in combination with the connector body to secure the connector to the cable.

3. A compression tool, comprising:

a fixed base defining a line of action, a cradle support defining a pivot axis orthogonal to the line-of-action, and a plunger configured to secure an end of a connector insert;

a compression member configured to slideably engage the fixed base along the line-of-action and receive a connector body within a recess, the compression member having cam follower surfaces radially-spaced from the pivot axis of the fixed base; and a handle having a cam engagement surface operatively coupled to each of the cam follower surfaces and pivotally mounted to the cradle support to bi-directionally displace the compression member to an open position and to a fully compressed position, wherein the cradle support includes a pair of lug structures each defining a bearing surface, wherein the handle includes stub axles projecting laterally from each side of the handle, and wherein each stub axle and bearing surface produce cooperating journal bearings to facilitate pivot motion of the handle within the cradle support.

4. The compression tool of claim 3 wherein each bearing surface opens to a channel extending vertically from the bearing surface to an upper portion of the respective lug, the channels of each lug structure facilitating assembly of the handle into the cradle support.

5. The compression tool of claim 3 further comprising a transition between the bearing surface and the vertical channel to effect a snap-fit connection between the stub axles of the handle and each of the bearing surfaces.

6. The compression tool of claim 1 wherein the fixed base defines at least one linear bearing surface and the compression member defines at least one guide surface slideable along the linear bearing surface.

7. The compression tool of claim 1 wherein in the open position the moveable compression member facilitates loading of the connector body into the recess, and wherein in the fully compressed position the moveable compression member applies a compressive force to the connector body and connector insert to secure the connector body to the cable.

8. A compression tool, comprising:

a fixed base defining at least one surface along a line-of-action and a static plunger configured to engage a portion of a connector, the fixed base including a cradle support defining a pivot axis orthogonal to the line-of-action, the cradle support including a pair of lug structures each defining a lug bearing surface;

a compression member having a guide surface configured to slideably engage the surface along the line of action, the compression member defining a recess configured to receive a connector body; and a handle pivotally mounted to the fixed base along a pivot axis orthogonal to the line of action and operative to slideably displace the compression member toward the static plunger to compress together the portion of the connector and the connector body, the handle including a pair of stub axles pivotally mounted to the cradle support along the pivot axis, wherein the stub axles project laterally from each side of the handle, and each stub axle and bearing surface produce cooperating journal bearings facilitating pivot motion of the handle within the cradle support.

9. The compression tool according to claim 8 wherein the handle bi-directionally pivots about the axis to axially displace the compression member along the line of action to an open position and to a fully compressed position.

10. The compression tool of claim 9 wherein the compression member slides forward to the open position to facilitate loading of a connector into the recess and wherein the compression member slides aft to the fully compressed position to secure the connector body to a cable.

11. The compression tool of claim 8 wherein each lug bearing surface opens to a channel extending vertically from the lug bearing surface to an upper portion of the respective lug, the channels of each lug structure facilitating assembly of the handle into the cradle support.

12. The compression tool of claim 8 further comprising a transition between the lug bearing surface and the vertical channel to effect a snap-fit connection between the stub axles of the handle and each of the lug bearing surfaces.

13. A compression tool, comprising:

a fixed base defining at least one surface along a line-of-action and a static plunger configured to engage a portion of a connector;

a compression member having a guide surface configured to slideably engage the surface along the line of action, the compression member defining a recess configured to receive a connector body; and a handle pivotally mounted to the fixed base along a pivot axis orthogonal to the line of action and operative to slideably displace the compression member toward the static plunger to compress together the portion of the connector and the connector body, wherein the static plunger is integral with the fixed base to define a unitary structure.

14. The compression tool of claim 9 wherein in the open position the moveable compression member facilitates loading of the connector body into the recess, and wherein in the fully compressed position the moveable compression member applies a compressive force to secure the connector body to a cable.

15. The compression tool according to claim 13 wherein the fixed base includes a pair of bearing channels defining the at least one surface and the compression member defines a pair of guide rails defining the guide surface.

16. The compression tool according to claim 13 wherein the at least one surface and the guide surface cooperate to provide lateral and vertical retention of the compression member relative to the fixed base.

* * * * *